US008408290B2

(12) United States Patent
Porter et al.

(10) Patent No.: US 8,408,290 B2
(45) Date of Patent: Apr. 2, 2013

(54) INTERCHANGEABLE DRILLABLE TOOL

(75) Inventors: Jesse C. Porter, Duncan, OK (US); William E. Standridge, Madill, OK (US); Adam K. Neer, Duncan, OK (US); Tracy Martin, Spring, TX (US); Kevin R. Manke, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 447 days.

(21) Appl. No.: 12/573,766

(22) Filed: Oct. 5, 2009

(65) Prior Publication Data

US 2011/0079383 A1 Apr. 7, 2011

(51) Int. Cl.
*E21B 23/01* (2006.01)
*E21B 33/129* (2006.01)

(52) U.S. Cl. ..... 166/134; 166/118; 166/138

(58) Field of Classification Search ..... 166/118, 166/134, 387, 381, 382, 138, 217, 206, 216, 166/135; 279/2.1, 2.11, 2.12, 2.14, 2.15
See application file for complete search history.

(56) References Cited

U.S. PATENT DOCUMENTS

| | | | | | |
|---|---|---|---|---|---|
| 2,076,313 | A | * | 4/1937 | Zschokke | 166/66.4 |
| 2,368,928 | A | * | 2/1945 | King | 277/337 |
| 2,772,740 | A | * | 12/1956 | Edwards | 166/129 |
| 2,870,794 | A | * | 1/1959 | Thaxton | 138/90 |
| 2,879,851 | A | * | 3/1959 | Wilson et al. | 166/216 |
| 3,077,933 | A | * | 2/1963 | Bigelow | 166/217 |
| 3,195,643 | A | * | 7/1965 | Harbison et al. | 166/138 |
| 3,216,504 | A | * | 11/1965 | Roark | 166/181 |
| 3,260,310 | A | * | 7/1966 | Brown | 166/131 |
| 3,285,343 | A | * | 11/1966 | Urbanosky | 166/134 |
| 3,298,440 | A | * | 1/1967 | Current | 277/340 |
| 3,358,766 | A | * | 12/1967 | Current | 277/337 |
| 3,420,305 | A | * | 1/1969 | Alexander et al. | 166/114 |
| 3,425,489 | A | * | 2/1969 | Brown | 166/129 |
| 3,429,375 | A | * | 2/1969 | Craig | 166/130 |
| 3,669,190 | A | * | 6/1972 | Sizer et al. | 166/387 |
| 3,684,010 | A | * | 8/1972 | Young | 166/129 |

(Continued)

FOREIGN PATENT DOCUMENTS

| | | | |
|---|---|---|---|
| EP | 1 197 632 | A2 | 4/2002 |
| WO | WO 2004070163 | A1 | 8/2004 |
| WO | WO 2009019483 | A2 | 2/2009 |
| WO | WO 2009019483 | A3 | 2/2009 |

OTHER PUBLICATIONS

Halliburton Sales & Service Catalog 43, pp. 2561-2562 and 2556-2557 (1985).

(Continued)

*Primary Examiner* — Brad Harcourt
(74) *Attorney, Agent, or Firm* — John W. Wustenberg; McAfee & Taft

(57) ABSTRACT

A downhole tool for use in a well has a mandrel with an expandable sealing element disposed thereabout. The mandrel has a head portion threadedly connected thereto. A shoulder in the head portion and an upper end of the mandrel define an annular space. A sleeve with a bore therethrough may be positioned in the annular space. The head portion may be removed and a solid plug installed so that it fits within the annular space and so that the downhole tool will act as a bridge plug. The downhole tool has slip rings made up of a plurality of individual slip segments that are adhesively bonded to one another at the sides thereof.

17 Claims, 5 Drawing Sheets

U.S. PATENT DOCUMENTS 3,705,624 A * 12/1972 Pitts ..... 166/216
3,710,866 A * 1/1973 Pitts ..... 166/216
3,802,505 A * 4/1974 Majors, Jr. ..... 166/136
3,860,067 A * 1/1975 Rodgers ..... 166/121
3,893,717 A * 7/1975 Nelson ..... 285/3
4,151,875 A 5/1979 Sullaway
4,185,689 A 1/1980 Harris
4,274,489 A * 6/1981 Harris ..... 166/387
4,457,369 A * 7/1984 Henderson ..... 166/125
4,532,989 A 8/1985 Barker
4,548,265 A * 10/1985 Luke ..... 166/140
4,573,537 A * 3/1986 Hirasuna et al. ..... 166/387
4,605,063 A * 8/1986 Ross ..... 166/216
4,653,588 A * 3/1987 White ..... 166/374
4,662,453 A * 5/1987 Brisco ..... 166/387
4,688,641 A * 8/1987 Knieriemen ..... 166/387
4,690,220 A * 9/1987 Braddick ..... 166/382
4,709,761 A * 12/1987 Setterberg, Jr. ..... 166/387
4,751,968 A * 6/1988 Ames et al. ..... 166/368
4,765,404 A 8/1988 Bailey et al.
4,856,591 A * 8/1989 Donovan et al. ..... 166/278
4,889,319 A * 12/1989 Phillips et al. ..... 251/368
4,901,794 A * 2/1990 Baugh et al. ..... 166/118
4,928,768 A * 5/1990 Peterson ..... 166/380
4,934,459 A * 6/1990 Baugh et al. ..... 166/380
5,058,671 A * 10/1991 Cochran ..... 166/124
5,058,672 A * 10/1991 Cochran ..... 166/124
5,224,540 A 7/1993 Streich et al.
5,261,492 A * 11/1993 Duell et al. ..... 166/387
5,271,468 A * 12/1993 Streich et al. ..... 166/387
5,297,579 A * 3/1994 McConnell et al. ..... 137/515.7
5,297,633 A * 3/1994 Snider et al. ..... 166/387
5,390,737 A * 2/1995 Jacobi et al. ..... 166/184
5,404,956 A * 4/1995 Bohlen et al. ..... 166/387
5,488,994 A * 2/1996 Laurel et al. ..... 166/387
5,540,279 A * 7/1996 Branch et al. ..... 166/118
5,682,952 A * 11/1997 Stokley ..... 166/373
5,701,959 A * 12/1997 Hushbeck et al. ..... 166/387
5,718,292 A * 2/1998 Heathman et al. ..... 166/387
5,839,515 A * 11/1998 Yuan et al. ..... 166/387
5,857,520 A 1/1999 Mullen et al.
5,931,229 A * 8/1999 Lehr et al. ..... 166/278
5,941,313 A * 8/1999 Arizmendi ..... 166/387
5,984,007 A * 11/1999 Yuan et al. ..... 166/134
6,102,117 A 8/2000 Swor et al.
6,167,963 B1 1/2001 McMahan et al.
6,209,652 B1 * 4/2001 Portman et al. ..... 166/379
6,220,349 B1 * 4/2001 Vargus et al. ..... 166/138
6,241,017 B1 * 6/2001 Doane et al. ..... 166/134
6,283,148 B1 * 9/2001 Spears et al. ..... 137/533.11
6,315,041 B1 11/2001 Carlisle et al.
6,318,460 B1 * 11/2001 Swor et al. ..... 166/138
6,354,372 B1 * 3/2002 Carisella et al. ..... 166/118
6,378,606 B1 * 4/2002 Swor et al. ..... 166/217
6,394,180 B1 5/2002 Berscheidt et al.
6,491,116 B2 * 12/2002 Berscheidt et al. ..... 175/57
6,598,672 B2 7/2003 Bell et al.
6,648,335 B1 * 11/2003 Ezell ..... 277/438
6,695,050 B2 * 2/2004 Winslow et al. ..... 166/118
6,695,051 B2 * 2/2004 Smith et al. ..... 166/134
6,708,770 B2 3/2004 Slup et al.
6,712,153 B2 * 3/2004 Turley et al. ..... 166/387
6,796,376 B2 * 9/2004 Frazier ..... 166/134
6,976,534 B2 * 12/2005 Sutton et al. ..... 166/134
7,017,672 B2 * 3/2006 Owen, Sr. ..... 166/387
7,048,066 B2 5/2006 Ringgenberg et al.
7,124,831 B2 10/2006 Turley et al.
7,243,733 B2 * 7/2007 McGuire et al. ..... 166/387
7,350,582 B2 4/2008 McKeachnie et al.
7,434,617 B2 * 10/2008 Artherholt ..... 166/202
7,434,627 B2 10/2008 Turley et al.
7,779,927 B2 8/2010 Turley et al.
8,047,279 B2 * 11/2011 Barlow et al. ..... 166/134
2002/0062962 A1 * 5/2002 Gary et al. ..... 166/305.1
2003/0037932 A1 * 2/2003 Guillory et al. ..... 166/387
2003/0111236 A1 * 6/2003 Serafin et al. ..... 166/387
2003/0188876 A1 * 10/2003 Vick et al. ..... 166/382
2004/0045723 A1 3/2004 Slup et al.
2004/0118560 A1 * 6/2004 Johnson et al. ..... 166/285
2004/0231836 A1 * 11/2004 Budde ..... 166/75.15
2005/0045332 A1 * 3/2005 Howard et al. ..... 166/302
2006/0131031 A1 * 6/2006 McKeachnie et al. ..... 166/376
2006/0207760 A1 * 9/2006 Watson et al. ..... 166/207
2007/0012439 A1 * 1/2007 McGuire et al. ..... 166/202
2007/0051521 A1 3/2007 Fike et al.
2007/0074873 A1 * 4/2007 McKeachnie et al. ..... 166/376
2007/0119600 A1 * 5/2007 Slup et al. ..... 166/387
2008/0017379 A1 * 1/2008 Tilghman ..... 166/298
2008/0060821 A1 * 3/2008 Smith et al. ..... 166/387
2008/0073086 A1 * 3/2008 Cook et al. ..... 166/387
2008/0271898 A1 * 11/2008 Turley et al. ..... 166/382
2009/0044957 A1 2/2009 Clayton et al.
2009/0145614 A1 * 6/2009 Cook et al. ..... 166/387
2009/0308604 A1 * 12/2009 Corre et al. ..... 166/250.17
2010/0012330 A1 * 1/2010 Ezell et al. ..... 166/387
2011/0005779 A1 * 1/2011 Lembcke ..... 166/387

OTHER PUBLICATIONS

International Search Report and Written Opinion of the International Searching Authority dated Jan. 19, 2011, in corresponding PCT Application No. PCT/GB2010/001850.

* cited by examiner

INTERCHANGEABLE DRILLABLE TOOL

BACKGROUND

This disclosure generally relates to tools used in oil and gas wellbores. More specifically, the disclosure relates to drillable packers and pressure isolation tools.

In the drilling or reworking of oil wells, a great variety of downhole tools are used. Such downhole tools often have drillable components made from metallic or non-metallic materials such as soft steel, cast iron or engineering grade plastics and composite materials. For example, but not by way of limitation, it is often desirable to seal tubing or other pipe in the well when it is desired to pump a slurry down the tubing and force the slurry out into the formation. The slurry may include for example fracturing fluid. It is necessary to seal the tubing with respect to the well casing and to prevent the fluid pressure of the slurry from lifting the tubing out of the well and likewise to force the slurry into the formation if that is the desired result. Downhole tools referred to as packers, frac plugs and bridge plugs are designed for these general purposes and are well known in the art of producing oil and gas.

Bridge plugs isolate the portion of the well below the bridge plug from the portion of the well thereabove. Thus, there is no communication from the portions above and below the bridge plug. Frac plugs, on the other hand, allow fluid flow in one direction but prevent flow in the other. For example, frac plugs set in a well may allow fluid from below the frac plug to pass upwardly therethrough but when the slurry is pumped into the well, the frac plug will not allow flow therethrough so that any fluid being pumped down the well may be forced into a formation above the frac plug. Generally, the tool is assembled as a frac plug or bridge plug. An easily disassemblable tool that can be configured as a frac plug or a bridge plug provides advantages over prior art tools. While there are some tools that are convertible, there is a continuing need for tools that may be converted between frac plugs and bridge plugs more easily and efficiently. In addition, tools that allow for high run-in speeds are desired.

Thus, while there are a number of pressure isolation tools on the market, there is a continuing need for improved pressure isolation tools including frac plugs and bridge plugs.

SUMMARY

A downhole tool for use in a well has a mandrel with an expandable sealing element having first and second ends disposed thereabout. The mandrel is a composite comprised of a plurality of wound layers of fiberglass filaments coated in epoxy. The downhole tool is movable from an unset position to a set position in the well in which the sealing element engages the well, and preferably engages a casing in the well. The sealing element is likewise movable from an unset to a set position. First and second extrusion limiters are positioned at the first and second ends of the sealing element. The first and second extrusion limiters may be comprised of a plurality of composite layers with rubber layers therebetween. In one embodiment, the extrusion limiters may comprise a plurality of layers of fiberglass, for example, fiberglass filaments or fibers covered with epoxy resin, with layers of rubber, for example, nitrile rubber adjacent thereto. The first and second extrusion limiters may have an arcuately shaped cross section and be molded to the sealing element.

First and second slip wedges are likewise disposed about the mandrel. Each of the first and second slip wedges have an abutment end which abuts the first and second extrusion limiters, respectively. The abutment end of the first and second slip wedges preferably comprise a flat portion that extends radially outwardly from a mandrel outer surface and has a rounded transition from the flat portion to a radially outer surface of the slip wedge.

First and second slip rings are disposed about the mandrel and will ride on the slip wedges so that the first and second slip wedges will expand the first and second slip rings radially outwardly to grippingly engage casing in the well in response to relative axial movement. The first and second slip rings each comprise a plurality of individual slip segments that are bonded to one another at side surfaces thereof. Each of the slip segments have end surfaces and at least one of the end surfaces has a groove therein. The grooves in the slip segments together define a retaining groove in the first and second slip rings. A retaining band is disposed in the retaining grooves in the first and second slip rings and is not exposed to fluid in the well.

The downhole tool has a head portion that is threaded to the mandrel. The head portion may be comprised of a composite material and the threaded connection is designed to withstand load experienced in the well. In addition, the thread allows the downhole tool to be easily disassembled so that the tool may be easily converted or interchanged between a frac plug and bridge plug.

DETAILED DESCRIPTION OF A PREFERRED EMBODIMENT

Figure 1:
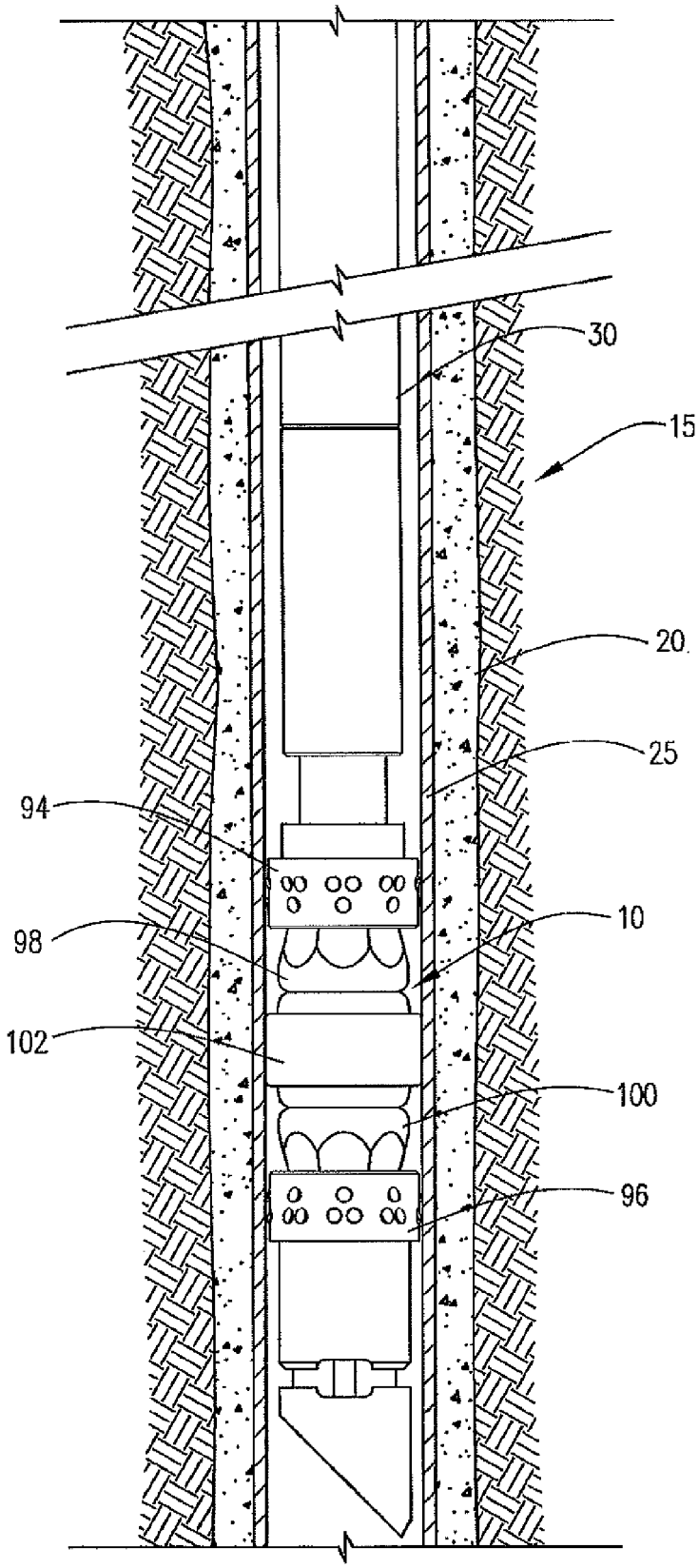
FIG. 1 schematically shows the tool in a well.

Referring now to FIG. 1, a downhole tool 10 is shown in a well 15 which comprises wellbore 20 with casing 25 cemented therein. Tool 10 may be lowered into well 15 on a tubing 30 or may be lowered on a wireline or other means known in the art. FIG. 1 shows tool 10 in its set position in the well.

Downhole tool 10 comprises a mandrel 32 with an outer surface 34 and inner surface 36. Mandrel 32 may be a composite mandrel constructed of a polymeric composite with continuous fibers such as glass, carbon or aramid, for example. Mandrel 32 may, for example, be a composite mandrel comprising layers of wound fiberglass filaments held together with an epoxy resin, and may be constructed by winding layers of fiberglass filaments around a forming mandrel. A plurality of fiberglass filaments may be pulled through an epoxy bath so that the filaments are coated with epoxy prior to being wound around the forming mandrel. Any number of filaments may be wound, and for example eight strands may be wound around the mandrel at a time. A plurality of eight strand sections wound around the forming mandrel and positioned adjacent to one another form a composite layer which may be referred to as a fiberglass/epoxy layer. Composite mandrel 32 comprises a plurality of the layers. Composite mandrel 32 has bore 40 defined by inner surface 36.

Mandrel 32 has upper or top end 42 and lower or bottom end 44. Bore 40 defines a central flow passage 46 therethrough. An end section 48 may comprise a mule shoe 48. In the prior art, the end section or mule shoe is generally a separate piece that is connected with pins to a tubular mandrel. Mandrel 32 includes mule shoe 48 that is integrally formed therewith and thus is laid up and formed in the manner described herein. Mule shoe 48 defines an upward facing shoulder 50 thereon.

Mandrel 32 has a first or upper outer diameter 52, a second or first intermediate outer diameter 54 which is a threaded outer diameter 54, a third or second intermediate inner diameter 56 and a fourth or lower outer diameter 58. Shoulder 50 is defined by and extends between third and fourth outer diameters 56 and 58, respectively. Threads 60 defined on threaded diameter 54 may comprise a high strength composite buttress thread. A head or head portion 62 is threadedly connected to mandrel 32 and thus has mating buttress threads 64 thereon.

Figure 2:
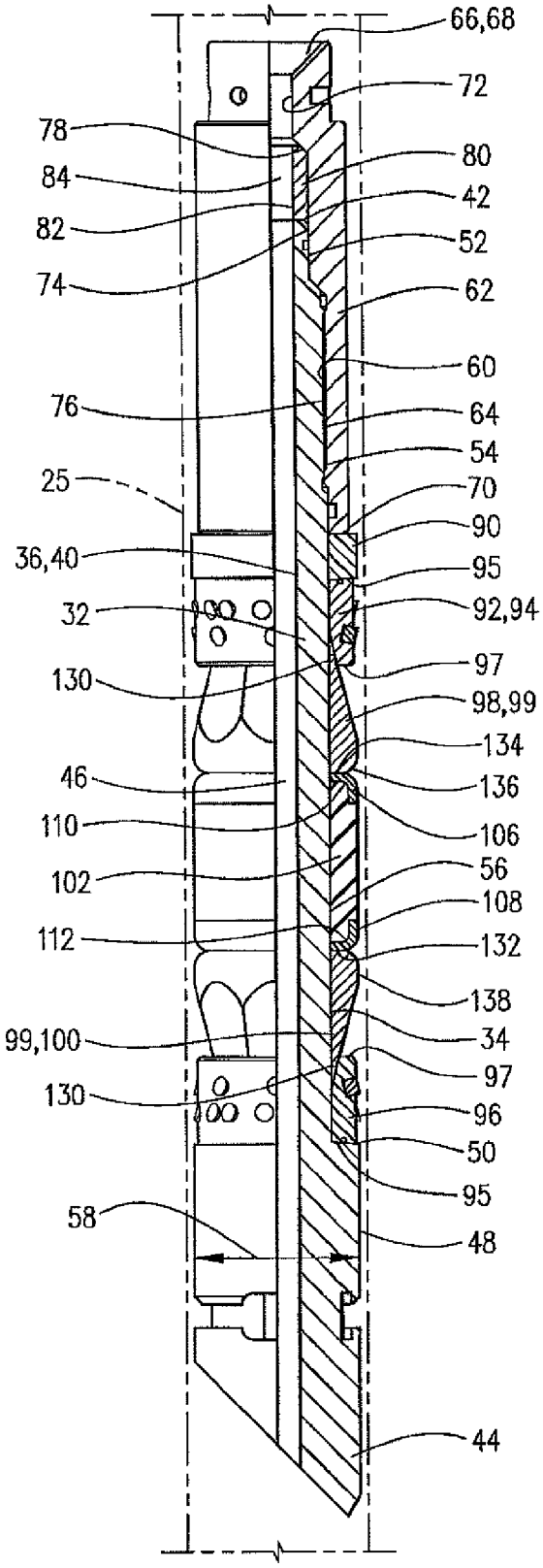
FIG. 2 is a partial section view showing an embodiment of the downhole tool.
Figure 4:
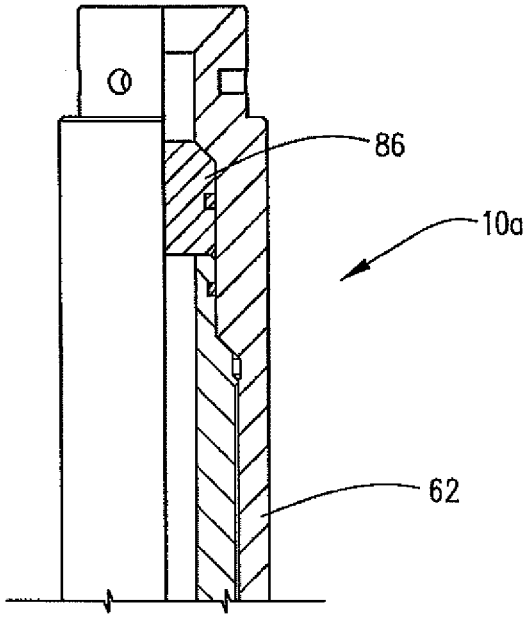
FIG. 4 shows an alternative embodiment of the upper portion of the tool.

Head portion 62 has an upper end 66 that may comprise a plug or ball seat 68. Head 62 has lower end 70 and has first, second and third inner diameters 72, 74, 76, respectively. Buttress threads 64 are defined on third inner diameter 76. Second inner diameter 74 has a magnitude greater than first inner diameter 72 and third inner diameter 76 has a magnitude greater than second inner diameter 74. A shoulder 78 is defined by and extends between first and second inner diameters 72 and 74. Shoulder 78 and upper end 42 of mandrel 32 define an annular space 80 therebetween. In the embodiment of FIG. 2, a spacer sleeve 82 is disposed in annular space 80. Spacer sleeve 82 has an open bore 84 so that fluid may pass unobstructed therethrough into and through longitudinal central passageway 46. As will be explained in more detail, head portion 62 is easily disconnected by unthreading from mandrel 32 so that instead of spacer sleeve 82 a plug 86, which is shown in FIG. 4 may be utilized. Plug 86 will prevent flow in either direction and as such the tool depicted in FIG. 4 will act as a bridge plug.

A spacer ring 90 is disposed about mandrel 32 and abuts lower end 70 of head portion 62 so that it is axially restrained on mandrel 32. Tool 10 further comprises a pair of slip rings 92, first and second, or upper and lower slip rings 94 and 96, respectively, with first and second ends 95 and 97 disposed about mandrel 32. A pair of slip wedges 99 which may comprise first and second or upper and lower slip wedges 98 and 100 are likewise disposed about mandrel 32. Sealing element 102, which is an expandable sealing element 102, is disposed about mandrel 32 and has first and second extrusion limiters 106 and 108 fixed thereto at first and second ends 110 and 112 thereof. The embodiment of FIG. 2 has a single sealing element 102 as opposed to a multiple piece packer sealing configuration.

Figure 6:
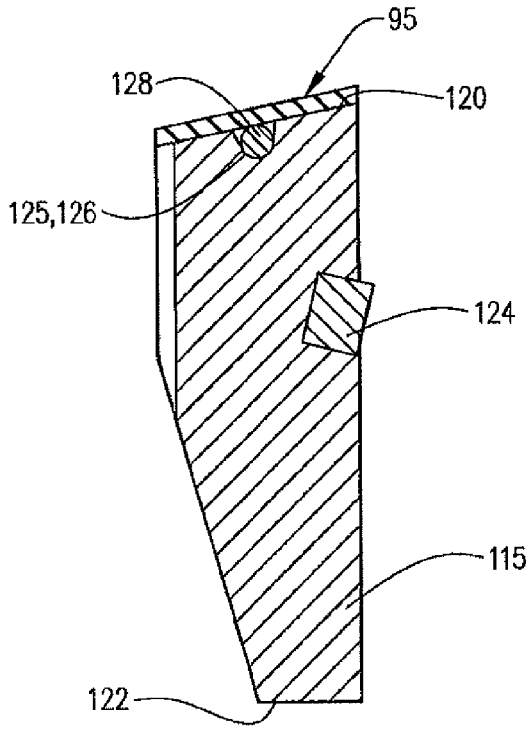
FIG. 6 shows a side view of a slip segment.
Figure 7:
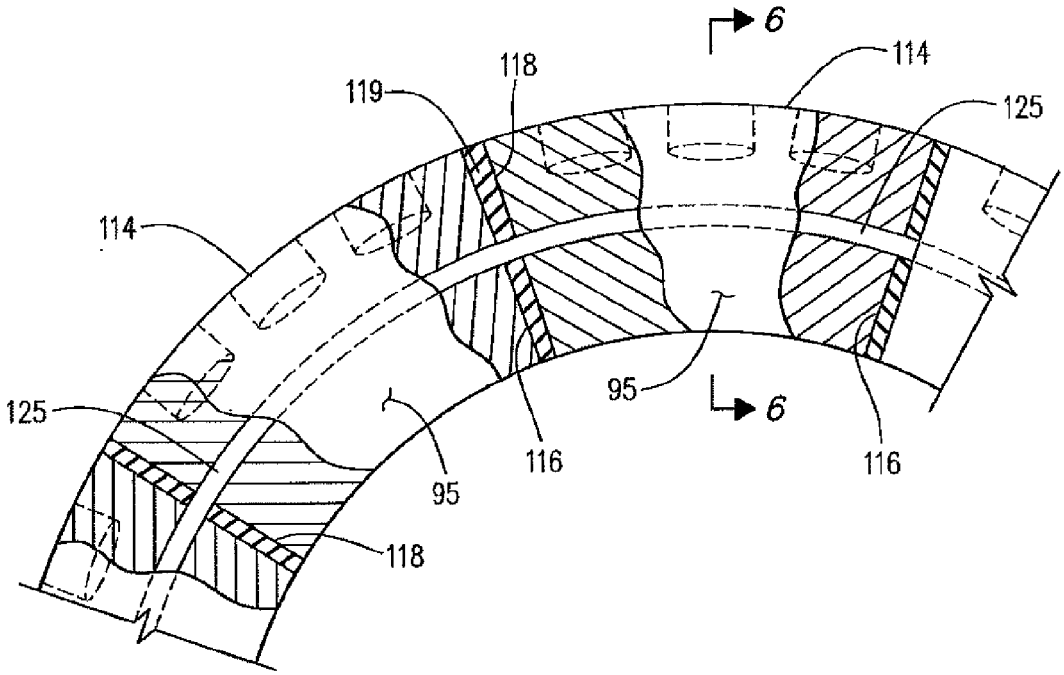
FIG. 7 is an end view of adhesively connected slip segments.

First and second slip rings 94 and 96 each comprise a plurality of slip segments 114. FIG. 6 is a cross section of a slip segment 114, and FIG. 7 shows a plurality of slip segments 114, bonded to one another. Slip segments 114 comprise a slip segment body 115 which is a drillable material, for example a woven mat of fiberglass, injected with epoxy and allowed to set. Other materials, for example molded phenolic can be used. Slip segment bodies 115 have first and second side faces or side surfaces 116 and 118 and first and second end faces or surfaces 120 and 122. Each of slip segment bodies 115 have a plurality of buttons 124 secured thereto. Thus, each of first and second slip rings 94 and 96 have a plurality of buttons 124 extending therefrom. When downhole tool 10 is moved to the set position, buttons 124 will grippingly engage casing 25 to secure tool 10 in well 15. Buttons 124 comprise a material of sufficient hardness to partially penetrate casing 25 and may be comprised of metallic-ceramic composite or other material of sufficient strength and may be for example like those described in U.S. Pat. No. 5,984,007.

Slip rings 94 and 96 each comprise a plurality of individual slip segments, for example, six or eight slip segments 114 that are bonded together at side surfaces thereof such that each side surface 118 is bonded to the adjacent slip segment 114 at side surface 116 thereof. Each slip segment 114 is bonded with an adhesive material such as for example nitrile rubber. FIG. 7, which is a top view with cutaway portions, shows a layer of adhesive 119 between adjacent segments 114 to connect slip segments 114 together. Each of slip rings 94 and 96 are radially expandable from the unset to the set position shown in FIG. 3 in which slip rings 94 and 96 engage casing 25. Because individual slip segments 114 are bonded together, slip rings 94 and 96, while radially expandable, comprise indivisible slip rings with connected slip segments. Such a configuration provides advantages over the prior art in that debris will not gather between slip segments and cause the tool to hang up in the well. Thus, downhole tool 10 may be run into well 15 more quickly than prior art tools.

Each of slip segment bodies 115 have grooves 125 in at least one of the end faces thereof, and in the embodiment shown in first end face 120. The ends of each groove 125 are aligned with the ends of grooves 125 in adjacent slip segments 114. Grooves 125 collectively define a groove 126 in each of slip rings 94 and 96. A retaining band 128 is disposed in each of retaining grooves 126. Grooves 126 may be of a depth such that retaining bands 128 are below the ends or end faces 120 of slip segment bodies 115. End 95 of slip rings 94 and 96 may be defined by a layer of adhesive, which may be the same adhesive utilized to bond slip segments 114 together, and may thus be, for example, nitrile rubber. The end layer of adhesive may be referred to as end layer 129. Retaining band 128 is completely encapsulated, and therefore will not be exposed to the well, or any well fluid therein. Retaining band 128 may thus be referred to as an encapsulated, or embedded retaining band 128, since it is completely covered by end layer 129. In the prior art, an uncovered retaining band was disposed in a groove around the periphery or circumference of the slip ring, which exposed the retaining band to the well. Oftentimes debris can contact such a slip ring retaining band which can damage the band so that it does not adequately hold the segments together. Thus, when a tool with the prior art configuration is lowered into the well interference may occur causing delays. Because there is no danger of slip segments 114 becoming separated and is no danger that retaining bands 128 will become hung or damaged by debris, downhole tool 10 may be run more quickly and efficiently than prior art tools.

First and second slip wedges 98 and 100 are generally identical in configuration but their orientation is reversed on mandrel 32. Slip wedges 99 have first or free end 130 and second or abutment end 132. The abutment end of first and second slip wedges 98 and 100 abut extrusion limiters 106 and 108, respectively. First end 130 of first and second slip wedges 98 and 100 is positioned radially between mandrel 32 and first and second slip rings 94 and 96, respectively, so that as is known in the art slip rings 94 and 96 will be urged radially outwardly when downhole tool 10 is moved from the unset to the set position. Abutment end 132 extends radially outwardly from outer surface 34 of mandrel 32 preferably at a 90° angle so that a flat face or flat surface 134 is defined. Abutment end 132 transitions into a radially outer surface 136 with a rounded transition or rounded corner 138 such that no sharp corners exist. Radially outer surface 136 is the surface that is the greatest radial distance from mandrel 32. Slip wedges 98 and 100 may thus be referred to as bull nosed slip wedges which will energize sealing element 102 outwardly into sealing engagement with casing 25. Because of the curved surfaces on the bull nosed slip wedges 98 and 100, the wedges provide a force that helps to push the extrusion limiters 106 and 108 radially outwardly to the casing, whereas standard wedges with a flat abutment surface apply an axial force only.

Extrusion limiters 106 and 108 are cup type extrusion limiters with an arcuate cross section. Extrusion limiters 106 and 108 may be bonded to sealing element 102 or may simply be positioned adjacent ends 110 and 112 of sealing element 102 and may be for example of composite and rubber molded construction. Extrusion limiters 106 and 108 may thus include a plurality of composite layers with adjacent layers of rubber therebetween. The outermost layers are preferably rubber, for example, nitrile rubber. Each composite layer may consist of woven fiberglass cloth impregnated with a resin, for example, epoxy. The extrusion limiters are laid up in flat configuration, cut into circular shapes and molded to a cup shape shown in cross section in FIG. 2. The flat circular shapes are placed into a mold and treated under pressure to form cup shaped extrusion limiters 106 and 108.

Figure 3:
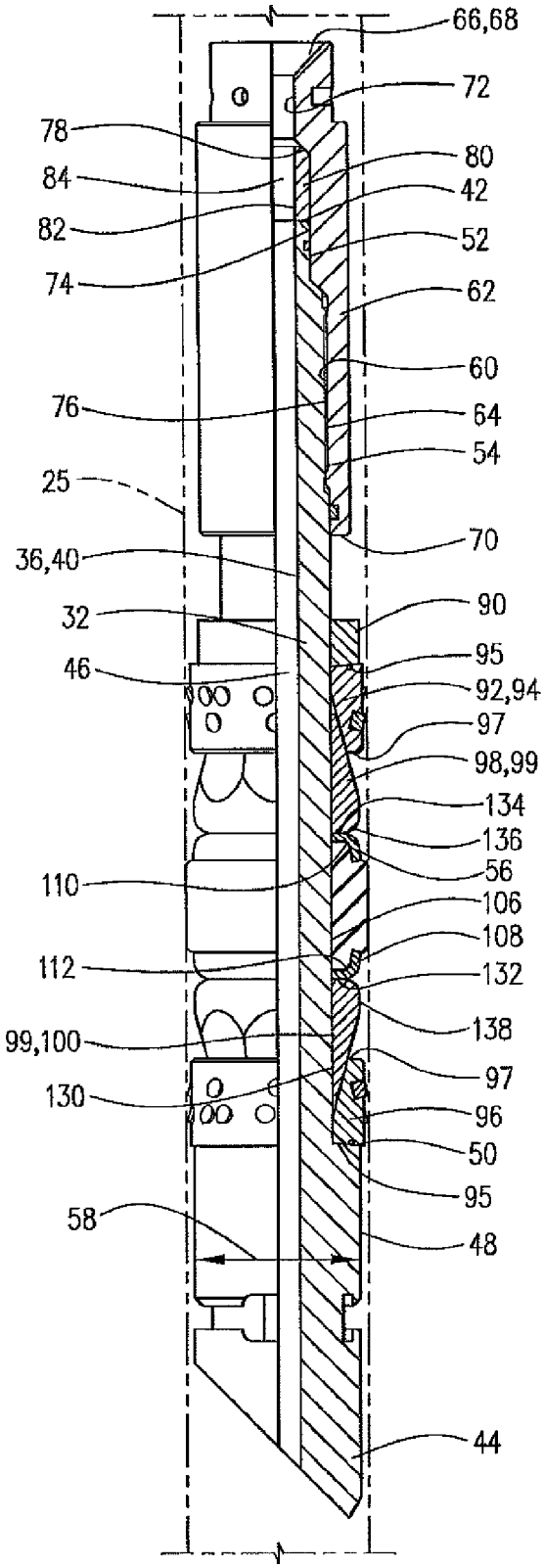
FIG. 3 shows the tool in a set position.

Downhole tool 10 is lowered into the hole in an unset position and is moved to a set position shown in FIG. 3 by means known in the art. In the set position, the slip rings 94 and 96 will move radially outwardly as they ride on slip wedges 98 and 100, respectively, due to movement of mandrel 32 relative thereto. It is known in the art that mandrel 32 will move upwardly and spacer ring 90 will be held stationary by a setting tool of the type known in the art so that slip rings 94 and 96 begin to move outwardly until each grippingly engage casing 25. Continued movement will ultimately cause slip wedges 98 and 100 to energize single sealing element 102 which will be compressed and which will expand radially outwardly so that it will sealingly engage casing 25 in well 15.

Downhole well tool 10 requires less setting force and less setting stroke than existing drillable tools. This is so because tool 10 utilizes single sealing element 102, whereas currently available drillable tools utilize a plurality of seals to engage and seal against casing in a well. Generally, drillable tools utilize a three-piece sealing element so downhole tool 10 uses one-third less force and has one-third less stroke than typically might be required. For example, known drillable four and one-half or five and one-half inch downhole tools utilizing a three-piece sealing element generally require about 33,000 pounds of setting force and about a 5½-inch stroke. Downhole tool 10 will require 22,000 to 24,000 pounds of setting force and a 3½ to 4-inch stroke. As downhole tool 10 is set, extrusion limiters 106 and 108 will deform or fold outwardly. Extrusion limiters 106 and 108 will thus be moved into engagement with casing 25 and will prevent seal 102 from extruding therearound.

Retaining bands 128 are protected from being broken because they are not exposed to well fluid or debris in the well. The non-exposed retaining bands, in addition to slip rings 94 and 96 which have segments that are attached to one another to lessen any fluid drag and to prevent debris from hanging up between segments allow downhole tool 10 to be run in at higher speeds. Because there is less risk of sticking in the well due to such causes, downhole tool 10 may be run into the well much more quickly and efficiently. Generally, tools using segment slips are lowered into a well at a rate of about 125 to 150 feet/minute. Tests have indicated that downhole tool 10 may be run at speeds in excess of 500 feet/minute.

The thread utilized to connect head portion 62 to mandrel 32 is adapted to withstand forces that may be experienced in the well and is rated for at least 10,000 psi, and must be able to withstand about 55,000 pounds of tensile downhole load for a 4½ or 5½ inch tool. Typically, threaded composites are unable to withstand such pressures. In addition, because head portion 62 is threadedly connected and may be easily disconnected, downhole tool 10 may be used in many configurations. In the configuration shown in FIG. 2, downhole tool 10 may be set in the well and utilized as a frac plug simply by dropping a sealing ball or sealing plug of a type known in the art into the well so that it will engage the seat 68. Once the sealing ball is engaged, fluid may be pumped into the well and forced into a formation above downhole tool 10. Once the desired treatment has been performed above downhole tool 10, the fluid pressure may be decreased and the fluid from a formation below downhole tool 10 is allowed to pass upwardly through downhole tool 10 to the surface along with any fluid from formations thereabove.

FIG. 4 shows the upper portion of a downhole tool 10*a* which is identical in all respects to downhole tool 10 except that plug 86 has been positioned in annular space 80. When tool 10*a* is set in the well, fluid flow in both directions is prevented so that downhole tool 10*a* acts as a bridge plug. As is apparent, the downhole tool is convertible from and between the frac plug configuration shown in FIG. 2 and the bridge plug configuration shown in FIG. 4 simply by unthreading head portion 62 and inserting either spacer sleeve 22 or plug 86 depending upon the configuration that is desired.

Figure 5:
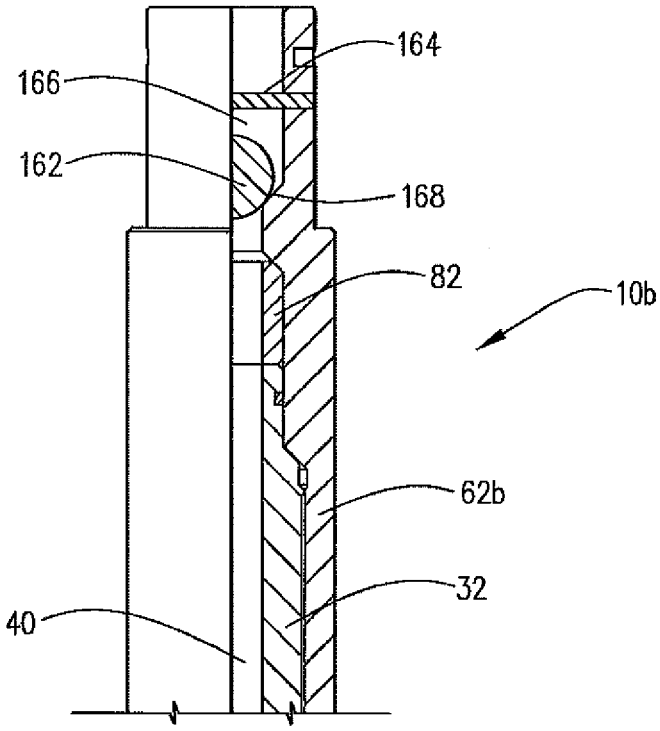
FIG. 5 is a partial cross section showing an additional embodiment.

FIG. 5 shows an embodiment referred to as downhole tool 10*b* which is identical in all respects to that shown in FIG. 2 except that the head portion thereof, which may be referred to as head portion 62*b*, has a cage portion 160 to entrap a sealing ball 162. Sealing ball 162 is movable in cage portion 160. A pin or other barrier 164 extends across a bore 166 of cage portion 160 and will allow fluid flow therethrough into the bore 40 of mandrel 32. Downhole tool 10*b* is a frac plug and does not require a ball or other plug dropped from the surface since sealing ball 162 is carried with tool 10*b* into the well. When tool 10*b* is set in the hole, fluid pressure from above will cause sealing ball 162 to engage the seat 168 in cage portion 160 and fluid may be forced into a formation thereabove. When treatment above tool 10*b* has been completed, fluid pressure may be relieved and fluid from below downhole tool 10 may flow therethrough past sealing ball 162 and bore 166 upwardly in the well. While FIGS. 2, 4 and 5 all show the use of first and second, or upper and lower extrusion limiters 106 and 108, when the downhole tool is utilized as a frac plug, the upper extrusion limiter 106 may be excluded.

It will be seen therefore, that the present invention is well adapted to carry out the ends and advantages mentioned, as well as those inherent therein. While the presently preferred embodiment of the apparatus has been shown for the purposes of this disclosure, numerous changes in the arrangement and construction of parts may be made by those skilled in the art. All of such changes are encompassed within the scope and spirit of the appended claims.

What is claimed is:

1. A downhole tool for use in a well comprising:

a mandrel;

a expandable sealing element disposed about the mandrel for engaging the well in a set position of the tool;

a first slip ring disposed about the mandrel and radially expandable outwardly from an unset to a set position in which the slip ring grippingly engages the well, the first slip ring comprising a plurality of slip segments having first and second side surfaces, each of the plurality of slip segments being bonded with a bonding material to an adjacent slip segment at the first and second side surfaces thereof;

a second slip ring disposed about the mandrel and expandable radially outwardly from an unset to a set position in which the second slip ring grippingly engages the well, the second slip ring comprising a plurality of slip segments having first and second side surfaces, each of the plurality of slip segments being bonded with the bonding material to adjacent slip segments at the first and second side surfaces thereof;

a groove defined in an end surface of each of the slip segments, wherein the grooves in the slip segments in the first slip ring collectively define a retaining groove therein, the groove in the slip segments in the second slip ring defining a retaining groove therein;

a first retaining band disposed in the retaining groove in the first slip ring; and a second retaining band disposed in the retaining groove in the second slip ring wherein, when the downhole tool is in the well, the first and second retaining bands are not exposed to the well.

2. The downhole tool of claim 1 wherein the first and second retaining band are not exposed to a fluid in the well when the downhole tool is in the well.

3. The downhole tool of claim 1 wherein:

the first retaining band and the second retaining band in the first and second slip rings are encapsulated.

4. The downhole tool of claim 1, the first and second slip rings each comprising an end layer covering the retaining bands, the end layer comprising the bonding material used to bond the slip segments together.

5. The downhole tool of claim 4, wherein the bonding material is nitrile rubber.

6. The downhole tool of claim 1, further comprising:

a sealing element having first and second end disposed about the mandrel and positioned between the first and second slip rings; and first and second extrusion limiters contacting the first and second ends of the sealing element, wherein the first and second extrusion limiters have an accurately shaped cross section in the unset position of the tool.

7. The downhole tool of claim 6, further comprising first and second slip wedges disposed about the mandrel, each having an abutment end, wherein the abutment end of the first and second slip wedges abuts the first and second extrusion limiters.

8. The downhole tool of claim 7 wherein the abutment end of each slip wedge comprises a flat portion extending radially outwardly from a mandrel outer surface and a rounded transition from the flat portion to a radially outer surface on the slip wedge such that the abutment end of the first slip wedge can provide axial force and radially outward force on the first extrusion limiter and the abutment end of the second slip wedge can provide axial force and radially outwards force of the second extrusion limiter.

9. The apparatus of claim 7, wherein the abutment ends of the first and second slip wedges compress the sealing element seal and move the sealing element to the set position.

10. A downhole tool for use in a well comprising:

a composite mandrel having a central flow passage therethrough:

a packer element disposed about the mandrel:

first and second slip rings disposed about the mandrel and positioned above and below the packer element, respectively;

a head portion threadedly and removably connected to the mandrel, the head portion configured to be convertible between a frac plug configuration and a bridge plug configuration and having an inner surface defining a downward facing shoulder and the mandrel having an upper end, wherein the downward facing shoulder on the head portion and the upper end of the mandrel define an annular space therebetween such that a spacer sleeve can be positioned in the annular space so as to allow fluid to pass unobstructed through the annular space and into the central flow passage or a plug can be positioned in the annular space so as to prevent fluid to pass through the annular space and into the central flow passage; and a spacer ring disposed about the mandrel for axially retaining the first slip ring, wherein a lower end of the head portion provides an abutment for the spacer ring.

11. The downhole tool of claim 10 further comprising a spacer sleeve positioned in the annular space and captured by the downward facing shoulder on the head portion and the upper end of the mandrel.

12. The downhole tool of claim 11, further comprising:

a ball movably disposed in the head portion; and a barrier to entrap the ball in the head portion, the head portion defining a ball seat, wherein the ball will engage the ball seat to prevent fluid flow through the downhole tool in a first direction, and is movable by fluid pressure off the ball seat to allow fluid flow in a second direction through the downhole tool.

13. The downhole tool of claim 10 further comprising a solid plug disposed in the head position and trapped between the upper end of the mandrel and the downward facing shoulder to provide flow through the tool.

14. The downhole tool of claim 10, wherein the head portion is comprised of a composite material.

15. A downhole tool for use in a well comprising:

a mandrel comprised of a composite material;

a single packer element disposed about the mandrel, the packer element being expandable from an unset position to a set position in which the packer element engages the well;

a first extrusion limiter adjacent a first end of the packer element; and a second extrusion limiter adjacent a second end of the packer element wherein each of the first and second extrusion limiters are arcuate in cross section in the unset position of the sealing element;

a first slip wedge disposed about the mandrel, the first slip wedge having an abutment end abutting the first extrusion limiter; and a second slip wedge disposed about the mandrel, the second slip wedge having an abutment end abutting the second extrusion limiter, wherein the first and second slip wedges have a radially outer surface and an arcuate transition from the abutment end thereof to the radially outer surface such that the arcuate transition and abutment end form an abutment surface such that the abutment surface of the first slip wedge can provide axial force and radially outward force on the first extrusion limiter and the abutment surface of the second slip wedge can provide axial force and radially outward force on the second extrusion limiter.

16. The downhole tool of claim 15 further comprising:

a first slip ring disposed about the mandrel and moveable from an unset to a set position in which the first slip ring grippingly engages the well; and a second slip ring disposed about the mandrel and movable from an unset to a set position in which the second slip ring grippingly engages the well, the first and second slip rings comprising a plurality of individual slip ring segments, each slip ring segment being adhesively bonded to an adjaced slip ring segment.

17. The downhole tool of claim 16, further comprising a retaining band disposed in a groove in the first and second retaining slip rings wherein the retaining bands are covered by an end layer bonded to an end surface of each of the slip segments.

* * * * *